US008434894B2

(12) United States Patent
Workman et al.

(10) Patent No.: US 8,434,894 B2
(45) Date of Patent: May 7, 2013

(54) LIGHTING APPARATUS; COMPONENTS THEREOF AND ASSEMBLIES INCORPORATING THE SAME

(75) Inventors: Robert Emmett Workman, Morgan, UT (US); Norm Krantz, Logan, UT (US)

(73) Assignee: Goal Zero LLC, Bluffdale, UT (US)

( * ) Notice: Subject to any disclaimer, the term of this patent is extended or adjusted under 35 U.S.C. 154(b) by 257 days.

(21) Appl. No.: 12/945,546

(22) Filed: Nov. 12, 2010

(65) Prior Publication Data

US 2011/0116254 A1 May 19, 2011

Related U.S. Application Data

(60) Provisional application No. 61/261,656, filed on Nov. 16, 2009.

(51) Int. Cl.
*F21S 4/00* (2006.01)
*F21V 21/00* (2006.01)

(52) U.S. Cl.
USPC ..... 362/249.01; 362/396; 362/436

(58) Field of Classification Search ..... 362/249.01, 362/249.06, 249.1, 249.11, 396, 391, 382, 362/436, 438, 217.16, 217.17; 439/226, 439/699.2
See application file for complete search history.

(56) References Cited

U.S. PATENT DOCUMENTS

| | | | | |
|---|---|---|---|---|
| 4,841,420 | A * | 6/1989 | Baggio et al. | 362/249.01 |
| 5,084,664 | A | 1/1992 | Gali | |
| 5,588,741 | A * | 12/1996 | Huang | 362/267 |
| 5,709,457 | A * | 1/1998 | Hara | 362/96 |
| 5,716,125 | A * | 2/1998 | Aubrey | 362/260 |
| 5,861,107 | A * | 1/1999 | Buysch et al. | 252/182.29 |
| 6,231,215 | B1 * | 5/2001 | Spitler et al. | 362/421 |
| D599,286 | S | 9/2009 | Horito et al. | |
| D600,000 | S | 9/2009 | Horito et al. | |
| 7,600,895 | B2 * | 10/2009 | Hawkins et al. | 362/249.01 |
| D625,251 | S | 10/2010 | Workman et al. | |
| D629,746 | S | 12/2010 | Workman et al. | |
| 2003/0090234 | A1 | 5/2003 | Glasgow et al. | |
| 2010/0102772 | A1 | 4/2010 | Smith | |

FOREIGN PATENT DOCUMENTS

WO WO 2009/149123 12/2009

OTHER PUBLICATIONS

U.S. Appl. No. 61/349,735, filed May 28, 2010, Workman et al.
U.S. Appl. No. 61/308,712, filed Feb. 26, 2010, Workman et al.
U.S. Appl. No. 61/350,364, filed Jun. 1, 2010, Workman et al.
U.S. Appl. No. 61/058,109, filed Jun. 2, 2008, Smith.
U.S. Appl. No. 61/261,656, filed Nov. 16, 2009, Workman et al.
U.S. Appl. No. 61/262,796, filed Nov. 19, 2009, Workman et al.
U.S. Appl. No. 12/983,677, filed Jan. 3, 2011, Workman et al.

* cited by examiner

*Primary Examiner* — John A Ward
(74) *Attorney, Agent, or Firm* — Foley & Lardner LLP

(57) ABSTRACT

A lighting apparatus includes a body portion, a conduit coupled to the body portion, and one or more illumination components coupled to the body portion, where the one or more illumination components are in electrical communication with the conduit. A lighting apparatus kit is also disclosed. A daisy-chained lighting apparatus assembly is also disclosed.

22 Claims, 10 Drawing Sheets

LIGHTING APPARATUS; COMPONENTS THEREOF AND ASSEMBLIES INCORPORATING THE SAME

CROSS REFERENCE TO RELATED APPLICATIONS

This patent application claims the benefit of priority under 35 U.S.C. §119(e) of U.S. Provisional Application No. 61/261,656, having a filing date of Nov. 16, 2009, titled "Lighting Apparatus; Components Thereof and Assemblies Incorporating the Same," the complete disclosure of which is hereby incorporated by reference.

FIELD

The disclosure relates to a lighting apparatus, components thereof and assemblies incorporating the same.

DESCRIPTION OF THE RELATED ART

There has always been a need to illuminate an otherwise inadequately-lighted area. Over time, people have illuminated inadequately-lighted areas by a variety of means including, for example: torches, oil lamps, candles and the like. Although such conventional means are acceptable for the purpose of illuminating an otherwise inadequately-lighted area, improvements over conventional illumination methodologies are still sought in order to advance the art.

BRIEF DESCRIPTION OF THE DRAWINGS

The disclosure will now be described, by way of example, with reference to the accompanying drawings, in which.

DETAILED DESCRIPTION

The Figures illustrate an exemplary embodiment of a lighting apparatus, components thereof and assemblies incorporating the same in accordance with an embodiment of the invention. Based on the foregoing, it is to be generally understood that the nomenclature used herein is simply for convenience and the terms used to describe the invention should be given the broadest meaning by one of ordinary skill in the art.

Figure 1:
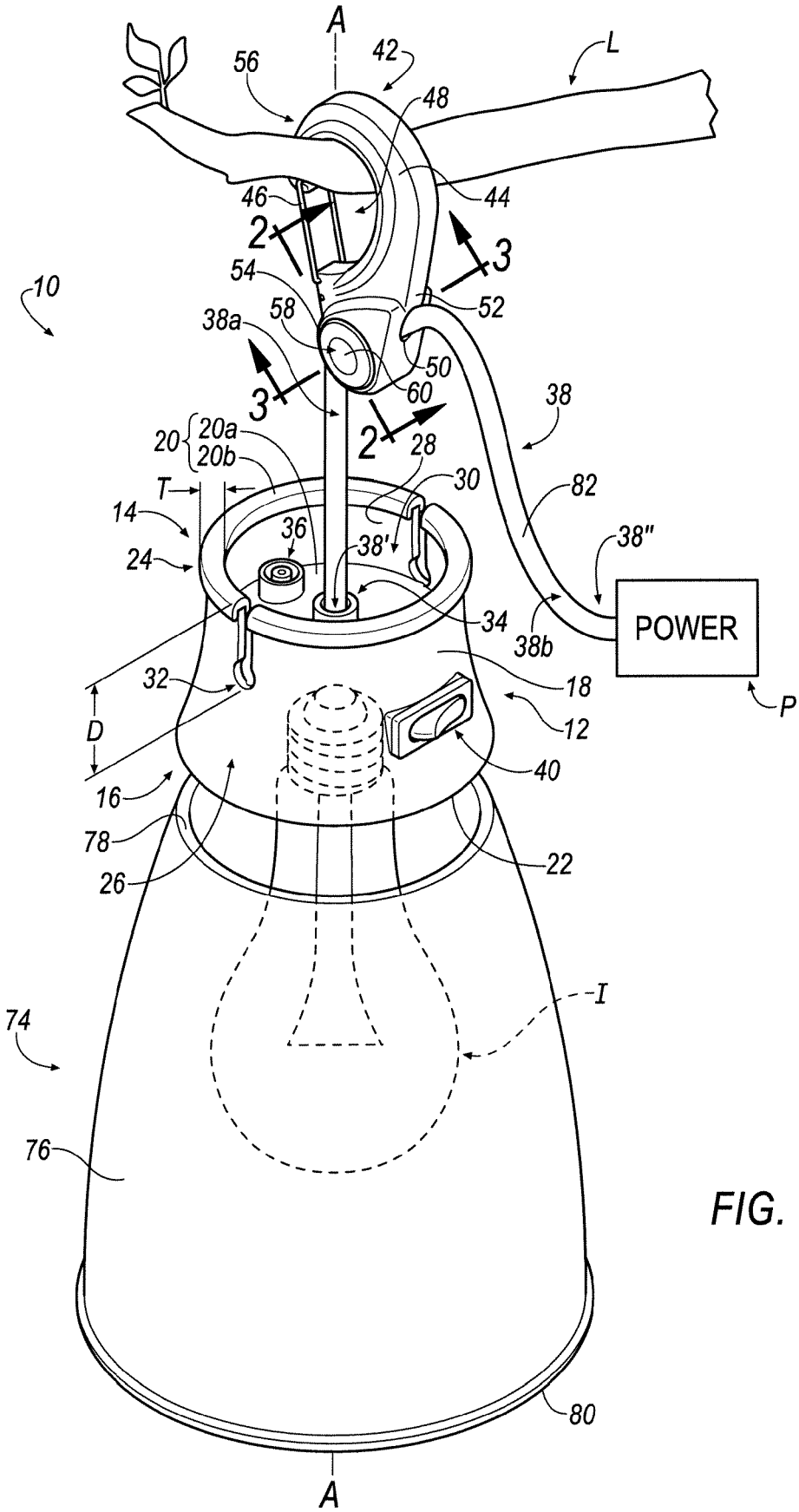
FIG. 1 is a isometric view of a lighting apparatus in accordance with an exemplary embodiment of the invention.

Referring to FIG. 1, a lighting apparatus is shown generally at 10 in accordance with an embodiment of the invention. In an embodiment, the lighting apparatus 10 includes a body portion 12 having an upper end 14 and a lower end 16. The body portion 12 includes an outer side surface 18, an upper surface 20 and a lower surface 22.

In an embodiment, the outer side surface 18 forms the body portion 12 to include a substantially cylindrical shape. In an embodiment, the outer side surface 18 tapers radially outwardly near the lower end 16. Although the body portion 12 is described to include a substantially cylindrical shape that tapers, it will be appreciated, however, that the body portion 12 is not limited to a particular shape, design or configuration and that the body portion 12 may be formed to include any shape design or configuration.

With continued reference to FIG. 1, in an embodiment, the body portion 12 may include a lip portion 24 formed by the upper end 14. In an embodiment, the body portion 12 may also include a base portion 26 formed by the lower end 16. In an embodiment, the upper surface 20 includes a first upper surface portion 20*a* formed by the base portion 26 and a second upper surface portion 20*b* formed by the lip portion 24. In an embodiment, the lip portion 24 extends away from the first upper surface portion 20*a* at a distance, D.

In an embodiment, the base portion 26 forms a portion of the cylindrical shape of the body portion 12 to be substantially solid whereas the lip portion 24 includes a circumferential thickness, T, that forms a portion of the cylindrical shape of the body portion 12 to be substantially hollowed. In an embodiment, the circumferential thickness, T, is bound by an inner side surface portion 28 and the outer side surface portion 18.

In an embodiment, because the circumferential thickness, T, forms a portion of the cylindrical shape of the body portion 12 to be substantially hollowed, the body portion 12 may form an axial passage 30 at least proximate the upper end 14 of the body portion 12. In an embodiment, the lip portion 24 may form the body portion 12 to include one or more radial openings 32 extending between the outer side surface 18 and the inner side surface 28. In an embodiment, the one or more radial openings 32 are located at least proximate the first upper surface portion 20*a*. In an embodiment, the one or more radial openings 32 are in communication with the axial passage 30.

It will be appreciated that the circumferential/axial/radial descriptions provided above are referenced from a central axis, A-A, extending through the body portion 12. However, it will be also appreciated that although the body portion 12 is described in the context of having a circumference/axis/radius, the body portion 12 is not limited to a particular shape, design or configuration.

In an embodiment, the first upper surface portion 20*a* forms a central access passage 34 that may extend at least partially through the base portion 26 to permit electrical communication with one or more illumination components, I, located at least proximate the lower surface 22 of the body portion 12. In an embodiment, the lower surface 22 may form one or more sockets (not shown) that permit the one or more illumination components, I, to be mechanically and/or electrically connected to the base portion 26. Further, in an embodiment, the first upper surface portion 20*a* may include a port 36, which will be described in greater detail in the foregoing disclosure at FIG. 11.

It will be appreciated that the one or more illumination components, I, is/are not limited to a particular embodiment. For example, the one or more illumination components, I, may include, but is not limited to: incandescent light bulbs, light-emitting-diodes, halogen lamps, fluorescent lamps or the like.

In an embodiment, the lighting apparatus 10 may further include a conduit 38 having a first end 38' and a second end 38". In an embodiment, the first end 38' of the conduit 38 may be connected to the base portion 26 and extend out of the access passage 34, beyond the first upper surface portion 20*a*, through the axial passage 30 and beyond the second upper surface portion 20*b* formed by the lip portion 24.

In an embodiment, the second end 38" of the conduit 38 may be connected to a power source, P. In an embodiment, the conduit 38 permits communication of electrical energy from the power source, P, to the one or more illumination components, I, in order to enable the one or more illumination components, I, to be illuminated.

In an embodiment, the second end 38" of the conduit 38 may be non-removably-attached to the power source, P. In an alternative embodiment, the second end 38" of the conduit 38 may be removably-attached (e.g., by way of, for example, a male-female plug connection) to the power source, P.

It will be appreciated that the power source, P, is not limited to a specific embodiment, design or configuration. For example, in an embodiment, the power source, P, may include mains/alternative current (AC)/direct current (DC) power, or the like. Alternatively, in an embodiment, the electrical power source, P, may include a battery, a solar cell, or the like. In an embodiment, the battery may include non-chargeable cells, re-chargeable cells or the like. In an embodiment, if the battery is re-chargeable, the battery may be charged by way of, for example, solar energy, AC/DC power, or the like.

In an embodiment, it will be appreciated that the body portion 12 may include/carry one or more electrical circuit components (e.g., resistors, capacitors, inductors, diodes and the like) that are connected to the one or more illumination components, I, in order to define an electrical circuit. Further, in an embodiment, the one or more electrical circuit components may include, for example, a switch 40 that may be positioned upon the outer surface 18. In an embodiment, the switch 40 may be moved to one of an "on" and "off" orientation in order to cause the electrical circuit to be in one of an opened orientation or a closed orientation to respectively "turn off" and "turn on" the one or more illumination components, I.

In an embodiment, the conduit 38 may include a first conduit portion 38*a* connected to a second conduit portion 38*b*. In an embodiment, the first conduit portion 38*a* is located proximate the first end 38' of the conduit 38. In an embodiment, the second conduit portion 38*b* is located proximate the second end 38" of the conduit 38.

In an embodiment, the first conduit portion 38*a* may include a substantially rigid, straight/linear body whereas the second conduit portion 38*b* may include a non-rigid, shapeable/formable body. In an embodiment, the first conduit portion 38*a* extends through the axial passage 30 formed by the lip portion 24. In an embodiment, the lip portion 24 forms a substantially rigid perimeter that may functionally protect the first conduit portion 38*a* from being inadvertently sheared off of the base portion 26.

In an embodiment, the lighting apparatus 10 may further include a latch 42. In an embodiment, the latch 42 includes a base member 44 and an arm portion 46 movably-connected to the base member 44.

In an embodiment, the base member 44, when viewed in cross-section resembles a substantially C-shaped body forming a channel 48. Further, in an embodiment, the base member 44 forms an enclosed passage 50 (see also FIGS. 2A-3B) that extends through the base member 44 from a first side 52 of the base member 42 to a second side 54 of the base member 44. In an embodiment, the conduit 38 extends through the enclosed passage 50 formed by the latch 42.

In an embodiment, the arm portion 46 is pivotably-connected to the base member 44 in order to permit or deny lateral access to the channel 48. In an embodiment, the arm portion 46 is biased to be located adjacent a distal tip 56 of base member 44 such that the arm portion 46 is said to be biased in a "closed orientation." When a force is applied to the arm portion 46, the bias may be overcome in order to move the arm portion 46 away from the distal tip 56 of the base member 44 such that the arm portion 46 may be said to be located in an "opened orientation."

In an embodiment, the latch 42 may be selectively moved along the conduit 38 between the first end 38' and the second end 38". Further, in an embodiment, once the latch 42 is selectively-moved to a desired location between the first end 38' and the second end 38" of the conduit 38, the latch 42 may be selectively-secured to the conduit 38 at the desirable location. As seen in FIGS. 1-3B, in an embodiment, the latch 42 may include a button assembly 58 that de/actuates the selective-securing of the latch 42 to the conduit 38. It will be appreciated that selective-securing of the latch 42 to the conduit 38 prevents the latch 42 from freely moving about the conduit 38 in a "free-floating" manner according to the direction of the arrows, X/X' (see, e.g., FIG. 3B).

Figure 2A:
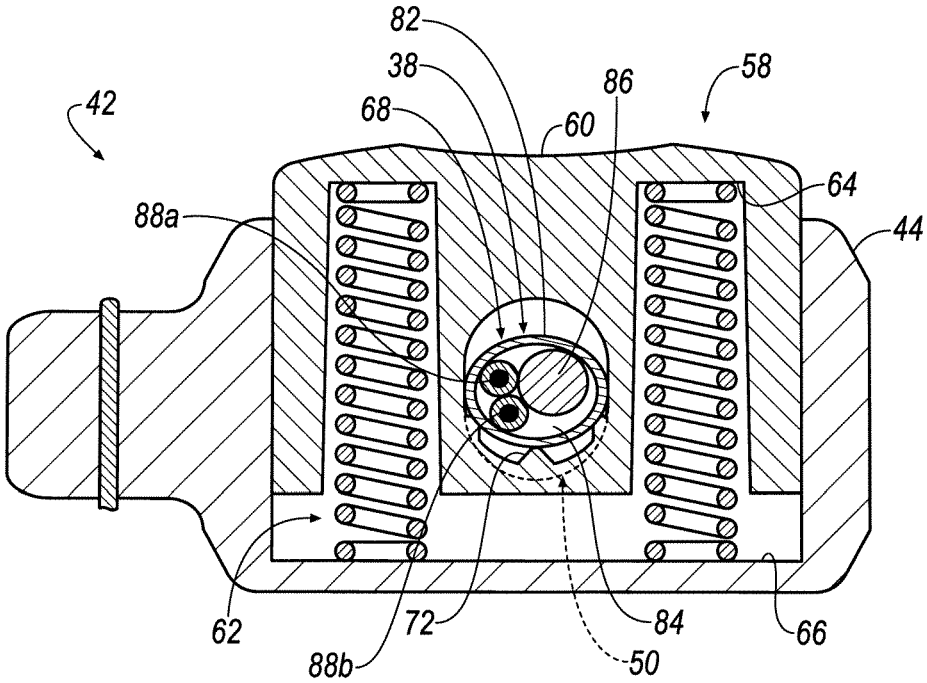
FIG. 2A is a cross-sectional view of a component of the lighting apparatus according to line 2-2 of FIGS. 1 and 4 in accordance with an exemplary embodiment of the invention.
Figure 2B:
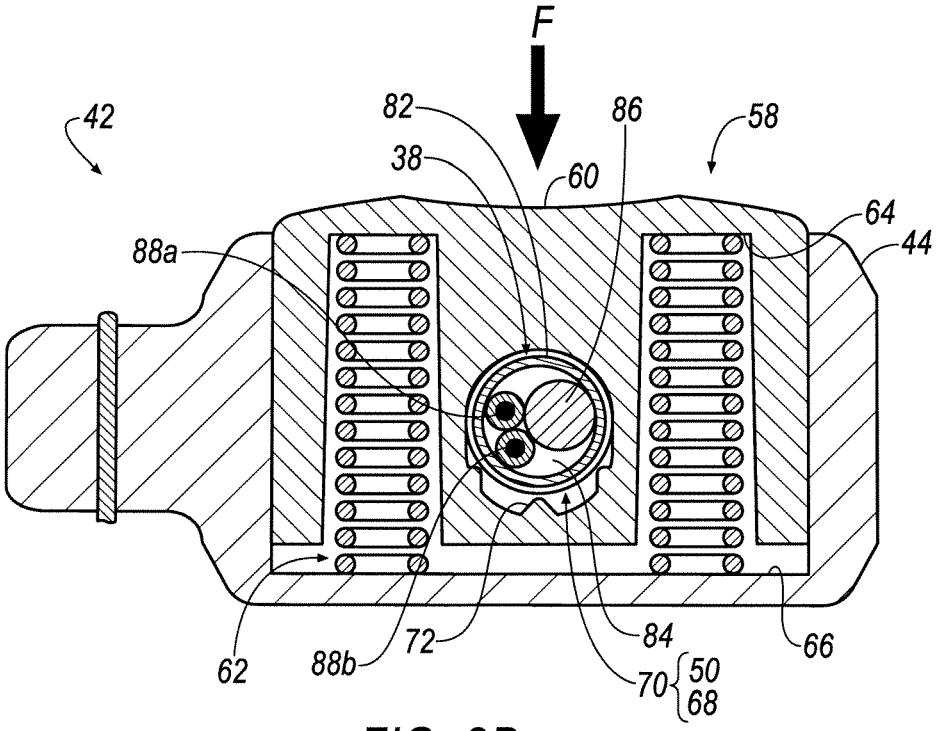
FIG. 2B is another cross-sectional view of the component of the lighting apparatus of FIG. 2A that is manipulated from a first orientation to a second orientation in accordance with an exemplary embodiment of the invention.
Figure 3A:
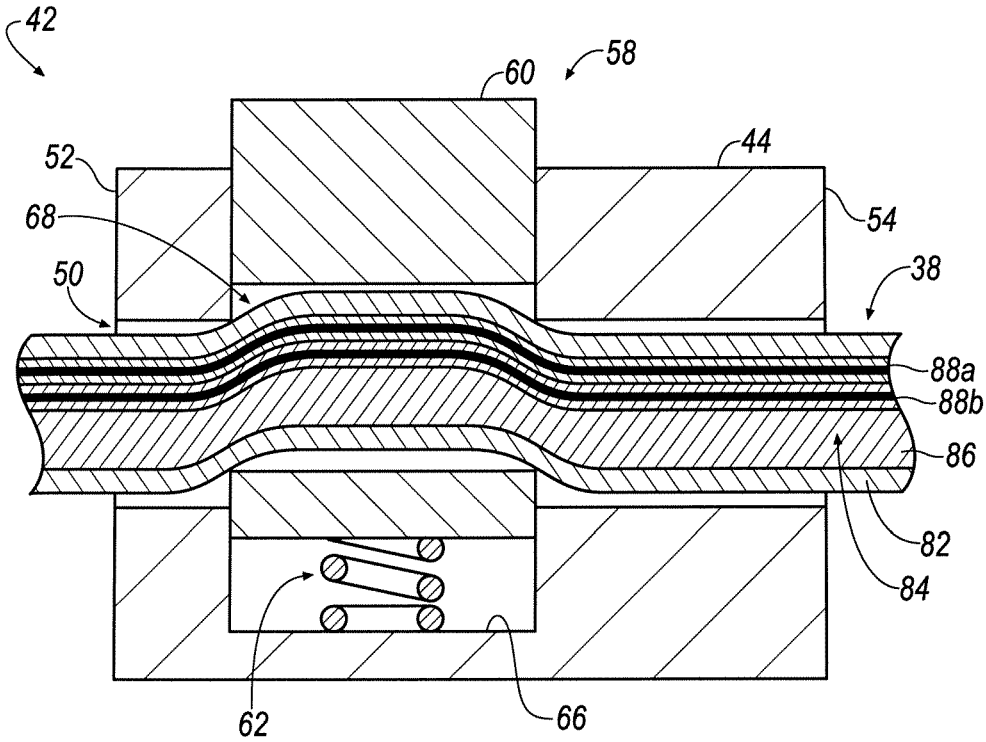
FIG. 3A is a cross-sectional view of a component of the lighting apparatus according to line 3-3 of FIGS. 1 and 4 in accordance with an exemplary embodiment of the invention.
Figure 3B:
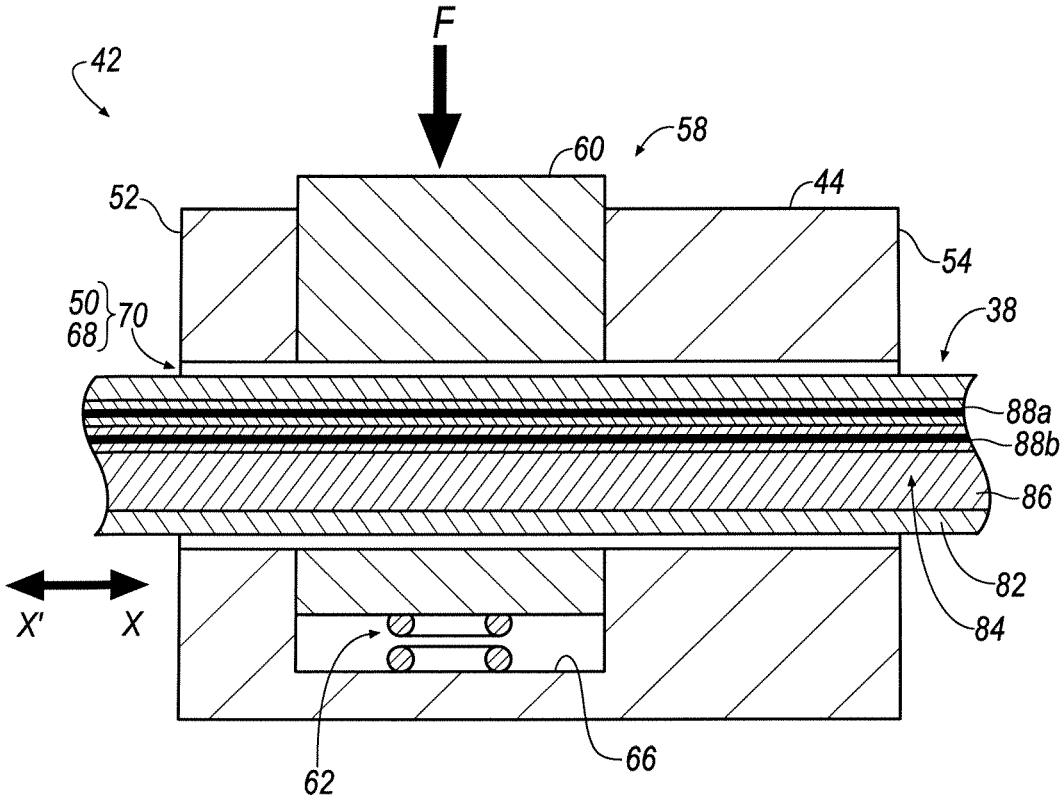
FIG. 3B is another cross-sectional view of the component of the lighting apparatus of FIG. 3A that is manipulated from a first orientation to a second orientation in accordance with an exemplary embodiment of the invention.

Referring to FIGS. 2A and 3A, the button assembly 58 is shown in a biased orientation, which results in the latch 42 being selectively-secured to the conduit 38 in a non-free-floating manner. Referring to FIGS. 2B and 3B, the button assembly 58 is shown in an un-biased orientation, which results in the latch 42 being permitted to be selectively-moved about the conduit 38 in a free-floating manner, X/X'.

As seen in FIGS. 2A-3B, the button assembly 58 includes a button member 60 that is movably-secured to the base member 44. In an embodiment, the button assembly 58 further includes a spring member 62 that contacts an inner surface 64 of the button member 60 and an inner surface 66 of the base member 44. In an embodiment, when the spring member 62 is arranged in an expanded orientation (see, e.g., FIGS. 2A, 3A), the spring member 62 biases the button member 60 to the biased orientation, which results in the latch 42 being selectively-secured to the conduit 38 (by frictionally pinching conduit 38 between button member 60 and base member 44); conversely, in an embodiment, when the button member 60 is depressed with a force, F (see, e.g., FIGS. 2B, 3B), the spring member 62 is arranged in a retracted orientation, which results in the latch 42 being permitted to be selectively-moved about the conduit 38 in a free-floating manner, X/X'.

Referring to FIGS. 3A-3B, the button member 60 further includes an enclosed passage 68. In an embodiment, the enclosed passage 68 may form a segment of the enclosed passage 50 such that the conduit 38 is said to also extend through the enclosed passage 68 of the button member 60.

In an embodiment, as seen in FIG. 3A, the enclosed passage 68 of the button member 60 may be arranged in an "out-of-alignment orientation" with respect to the enclosed passage 50 formed by the base member 44 when the spring member 62 is arranged in an expanded orientation; as such, it will be appreciated that the latch 42 may be inhibited from being able to freely-move relative the conduit 38 in the free-floating manner, X/X'. Conversely, in an embodiment, the enclosed passage 68 of the button member 60 may be arranged in an "aligned orientation" with the enclosed passage 50 formed by the base member 44 when the spring member 62 is arranged in the retracted orientation. In an embodiment, when the spring member 62 is arranged in the retracted orientation, the alignment of the enclosed passages 50, 68 forms an aligned passage 70. As such, it will be appreciated that when the aligned passage 70 is formed, the latch 42 may be permitted to freely-move relative the conduit 38 that extends through the aligned passage 70.

Referring to FIGS. 2A-2B, it will be appreciated that the enclosed passage 68 of the button member 60 may be further defined by one or more surface interruptions 72 that enhances the frictional capabilities of the button member 60. In an embodiment, the one or more surface interruptions 72 may include one or more ribs. In an embodiment, the one or more ribs 72 may serve to frictionally "bite" into the conduit 38 when the spring member 62 biases the button member 60 to the biased orientation.

Referring to FIG. 1, the latch 42 may be secured to an object, L. In an embodiment, the arm portion 46 may be moved to the opened orientation to permit the object, L, to be laterally inserted into the channel 48. Once the object, L, is disposed in the channel 48, the arm portion 46 is arranged in the closed orientation. Because the conduit 38 is extended through the enclosed passage 50 formed by the latch 42, and, because the conduit 38 is connected to the body portion 12, the lighting apparatus 10 may be said to be indirectly-coupled to the object, L, by way of the latch 42.

In an embodiment, the object, L, may include, for example, a tree limb. It will be appreciated, however, that although the latch 42 is shown being removably-secured to a tree limb, L, the lighting apparatus 10 is not limited to being removably-secured to a tree limb, L, and, as such, it will be appreciated that the lighting apparatus 10 may be secured to any desirable object. Further, it will be appreciated that although the description of a tree limb, L, may infer that the lighting apparatus 10 is usable outside of a home, building or the like (i.e., the lighting apparatus 10 may be useable "outdoors"), it will be appreciated that the lighting apparatus 10 is not exclusive to a particular environment and that the lighting apparatus 10 may be utilized within a home, building or the like (i.e., "indoors"). If, for example, the lighting apparatus 10 is used "outdoors," the one or more radial openings 32 may permit drainage of a fluid (e.g., rain water) that would otherwise fill the axial passage 30.

With continued reference to FIG. 1, the lighting apparatus 10 may also include a shade portion 74. The shade portion 74 includes a substantially tubular body 76 that functionally directs light from the one or more illumination components, I, in a specific direction. In an embodiment, the shade portion 74 includes an upper surface 78 and a lower surface 80. In an embodiment, it will be appreciated that the shade portion 74 may be integral with the body portion 12, or, alternatively, in an embodiment, the upper surface 78 of the shade portion 74 may be removably-attached to the lower surface 22 of the body portion 12.

With reference to FIGS. 2A-3B, the conduit 38 is described in greater detail. In an embodiment, the conduit 38 includes a tubular, insulating sheath 82 defining an inner passage 84. In an embodiment, the conduit 38 further includes a shapeable, non-conducting member 86 extending through the inner passage 84. In an embodiment, the conduit 38 further includes a first electrically-conducting member 88*a* extending through the inner passage 84 and a second electrically-conducting member 88*b* extending through the inner passage 84.

In an embodiment, the first and second electrically-conducting members 88*a*, 88*b* permit the conduit 38 to communicate energy from the power source, P, to the one or more illumination components, I, in order to enable the one or more illumination components, I, to be illuminated. In an embodiment, the first electrically-conducting member 88*a* may be referred to as a positive lead (+) whereas the second electrically-conducting member 88*b* may be referred to as a negative lead (−).

In an embodiment, the tubular sheath 82 may be formed to include one or more physical characteristics. For example, in an embodiment, the tubular, insulating sheath 82 of the first conduit portion 38*a* may form the substantially rigid, straight/linear body, and, the tubular, insulating sheath 82 of the second conduit portion 38*b* may include a non-rigid, formable body; accordingly, in an embodiment, it will be appreciated, that, if, for example, tubular, insulating sheath 82 of the second conduit portion 38*b* is bent, the malleable, non-conducting member 86 extending through the inner passage 84 of the second conduit portion 38*b* may permit the bent orientation of the tubular, insulating sheath 82 of the second conduit portion 38*b* to retain its bent orientation. However, it will be appreciated that because the tubular, insulating sheath 82 of the first conduit portion 38*a* is substantially rigid, it will be appreciated that the substantially rigid quality may prevent the first conduit portion 38*a* from being bent or selectively-shaped; as such, it will be appreciated that the shapeable, non-conducting member 86 extending through the inner passage 84 of the first conduit portion 38*a* remains in a virgin/non-bent orientation.

Figures 4, 5:
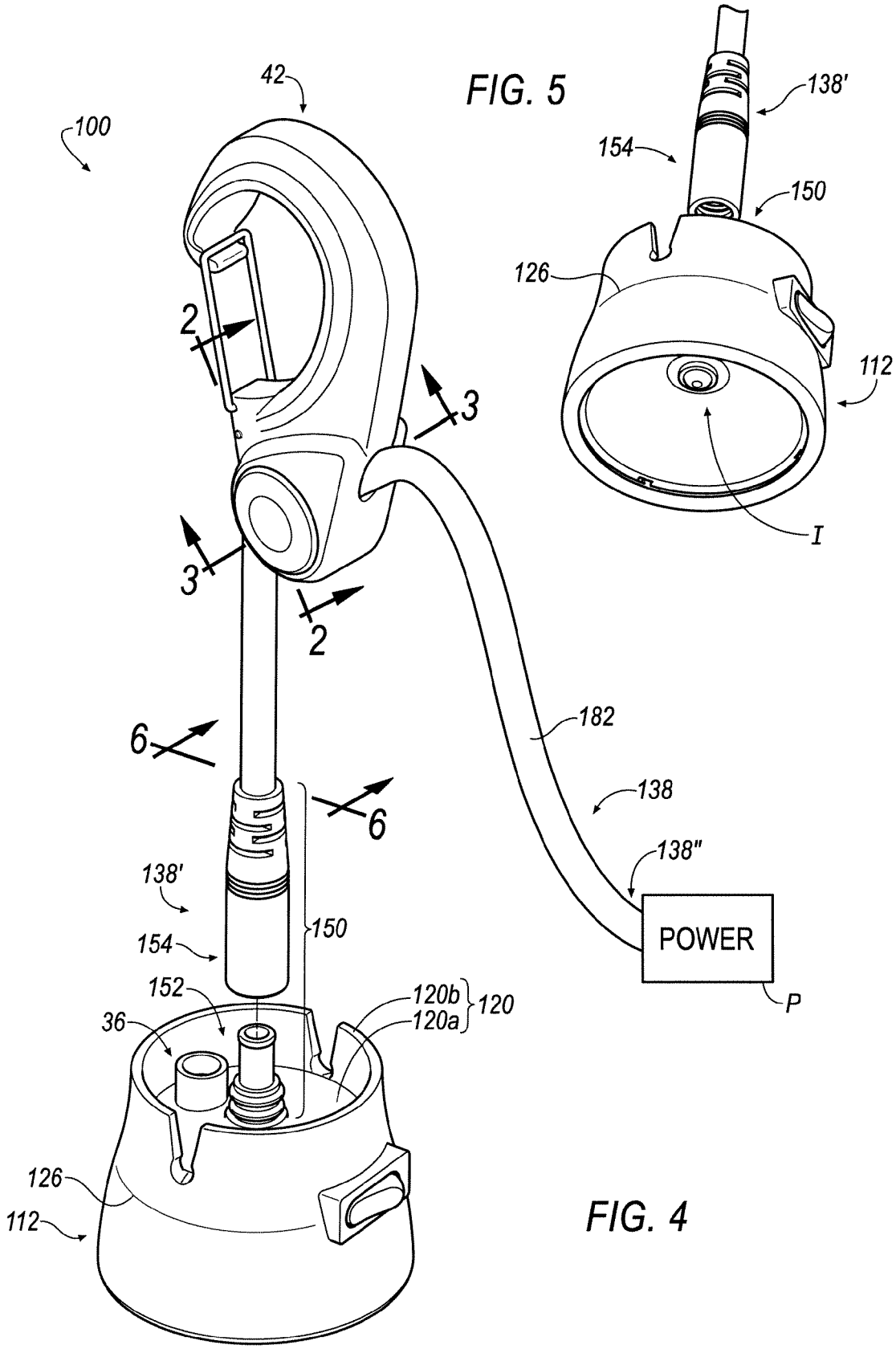
FIG. 4 is an exploded, upper isometric view of a lighting apparatus in accordance with an exemplary embodiment of the invention.
FIG. 5 is an exploded, lower isometric view of the lighting apparatus of FIG. 4 in accordance with an exemplary embodiment of the invention.

Referring now to FIGS. 4-5, a lighting apparatus is shown generally at 100 in accordance with an exemplary embodiment of the invention. In an embodiment, the lighting apparatus 100 is substantially similar to the lighting apparatus 10; however, the lighting apparatus 100 includes a body portion 112 and a conduit 138 having an alternative design/configuration.

Prior to describing the configuration of the lighting apparatus 100, in an embodiment, the lighting apparatus 10 may be said to be arranged in non-modular orientation. For example, in an embodiment, the first end 38' of the conduit 38 may by non-removably-affixed to the base portion 26 of the body portion 12. Conversely, in an embodiment, the lighting apparatus 100 may include modular interface 150 that permits that lighting apparatus 100 to be connected in a modular orientation. For example, in an embodiment, a first end 138' of the conduit 138 may be removably-affixed to a base portion 126 of the body portion 112.

In an embodiment, the modular interface 150 may include any desirable configuration. For example, in an embodiment, the base portion 126 of the lighting apparatus 100 may include a male portion 152 extending from the first upper surface portion 120*a*, and, the first end 138' of the conduit 138 may include a female portion 154.

When the male portion 152 is selectively-coupled to the female portion 154, the modular interface 150 permits the conduit 138 to communicate energy from the power source, P, to the one or more illumination components, I, in order to enable the one or more illumination components, I, to be illuminated. Further, if it is desired to disassemble the lighting apparatus 100, the male portion 152 may be selectively-decoupled from the female portion 154.

Figure 6:
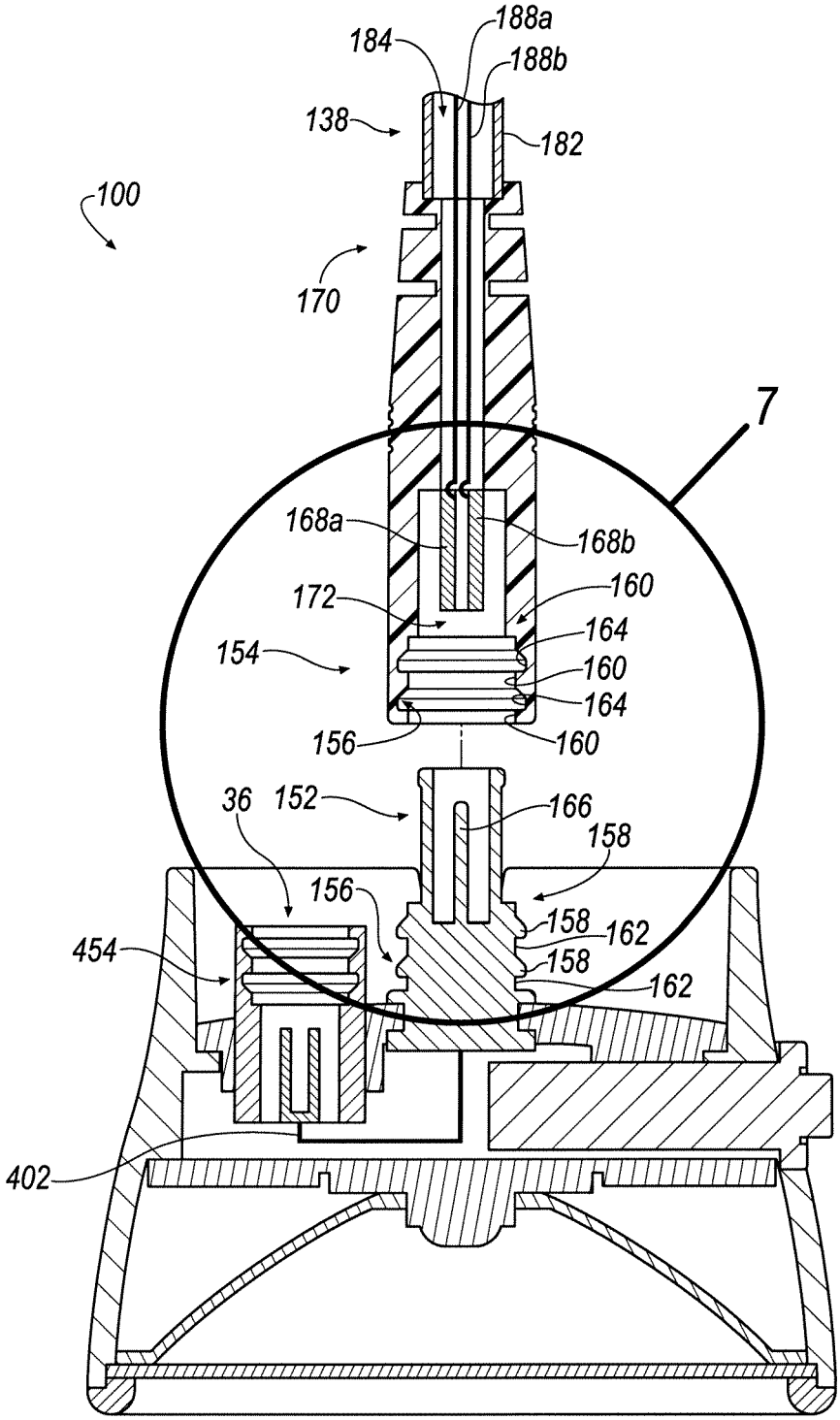
FIG. 6 is a cross-sectional view of the lighting apparatus according to line 6-6 of FIG. 4 in accordance with an exemplary embodiment of the invention.

Referring to FIG. 6, each of the male portion 152 and the female portion 154 may include cooperating surfaces 156 that permit the male and female portions 152, 154 to be mechanically-coupled to one another. In an embodiment, the male portion 152 may include an substantially rigid, electrically-conductive body 158, and, in an embodiment the female portion 154 may include a tubular, substantially flexible, insulating sleeve 160; accordingly, in an embodiment, it will be appreciated that as the male portion 152 is inserted into the female portion 154, the female portion 154 may be permitted to temporality deform relative the substantially rigid, electrically-conductive body 158, such that the cooperating surfaces 156 results an audible "snap" and/or tactile-feedback sensation, which may indicate that the male and female portions 152, 154 have been selectively-coupled.

In an embodiment, the cooperating surfaces 156 formed by each of the male and female portions 152, 154 may be formed by one or more ribs 158, 160 and one or more recesses 162, 164. In an embodiment, when the male and female portions 152, 154 are selectively-coupled, the one or more ribs 158 of the male portion 152 are registered within the one or more corresponding recesses 164 of the female portion 154, and, as well, the one or more ribs 160 of the female portion 154 are registered within the one or more corresponding recesses 162 of the male portion 152. When the male and female portions 152, 154 are selectively-coupled by way of, for example, the cooperating surfaces 156, the male and female portions 152, 154 may be said to be mechanically-coupled. Cooperating surface 156 of 152 and 156 of 154 effectively support the vertical load imposed by body 112 and prevent the body 112 from separating from female portion 154 due to the gravitational load imposed on body 112.

With continued reference to FIG. 6, the male portion 152 may further include one or more projecting, electrically-conductive leads 166, and, the female portion 154 may further include one or more projecting, electrically-conductive leads 168*a*, 168*b*. In an embodiment, when the one or more projecting, electrically-conductive leads 166 of the male portion 152 comes into contact with the one or more projecting, electrically-conductive leads 168*a*, 168*b* of the female portion 154, the male and female portions 152, 154 may be said to be electrically-coupled.

Figure 7:
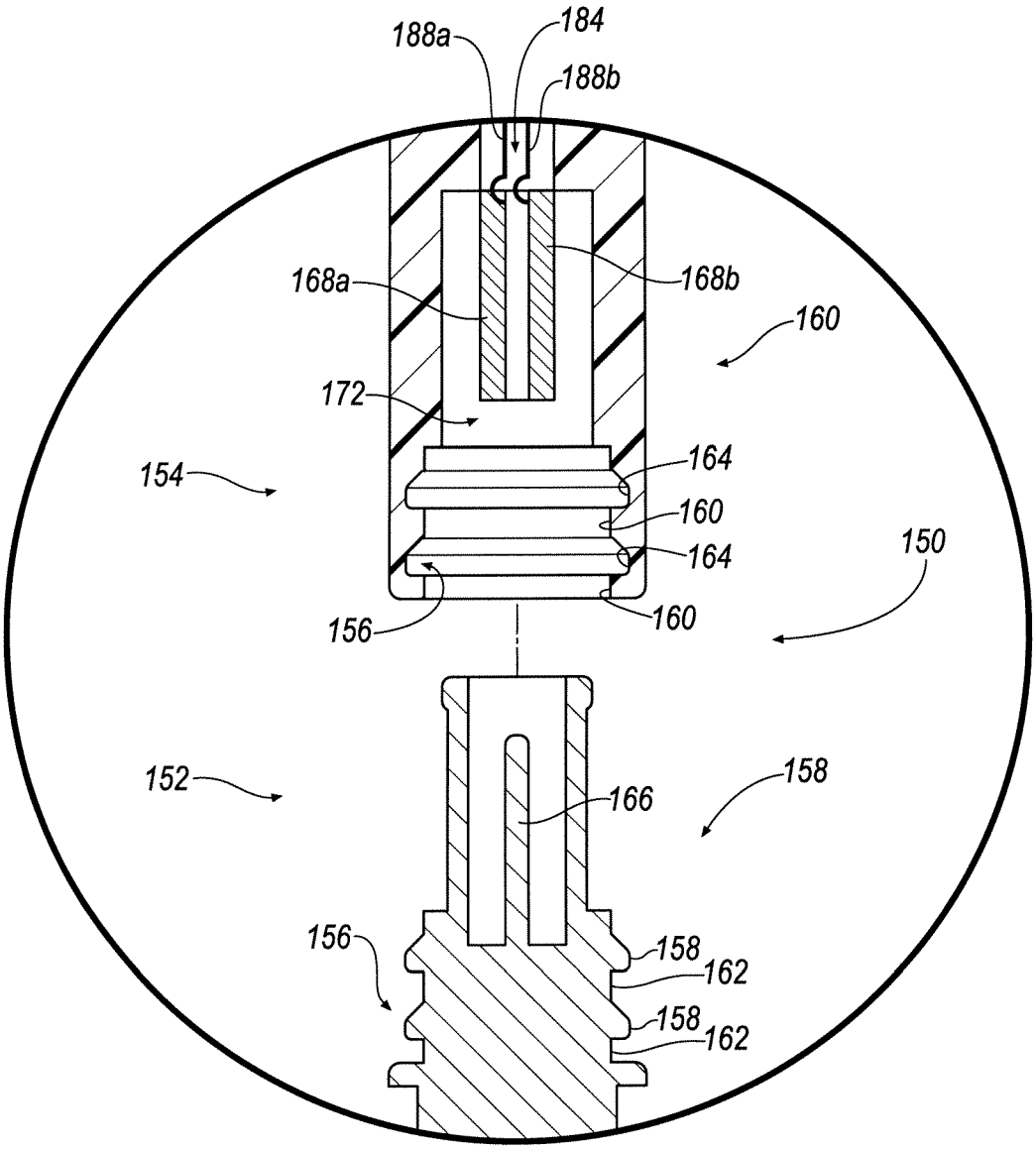
FIG. 7 is an enlarged view of the lighting apparatus according to line 7 of FIG. 6 in accordance with an exemplary embodiment of the invention.

With reference to FIG. 6, in an embodiment, the tubular, insulating sheath 182 of the conduit 138 may be connected to a distal end 170 of the female portion 154 such that the inner passage 184 of the tubular, insulating sheath 182 is in communication with a inner passage 172 extending through the female portion 154. In an embodiment, the first and second electrically-conducting members 188*a*, 188*b* of the conduit 138 may extend into the inner passage 172 formed by the female portion 154. Referring to FIGS. 6-7, in an embodiment, the first electrically-conducting member 188*a* is connected to the first projecting, electrically-conductive lead 168*a*, and the second electrically-conducting member 188*b* is connected to the second projecting, electrically-conductive lead 168*b* in order to communicate energy from the power source, P, to the one or more illumination components, I, by way of the male and female portions 152, 154 in order to enable the one or more illumination components, I, to be illuminated.

Referring to FIG. 4, in an embodiment, a second end 138" of the conduit 138 may be non-removably-attached to the power source, P. In an alternative embodiment, the second end 138" of the conduit 138 may be removably-attached (e.g., by way of, for example, a male-female plug connection) to the power source, P.

Figure 8:
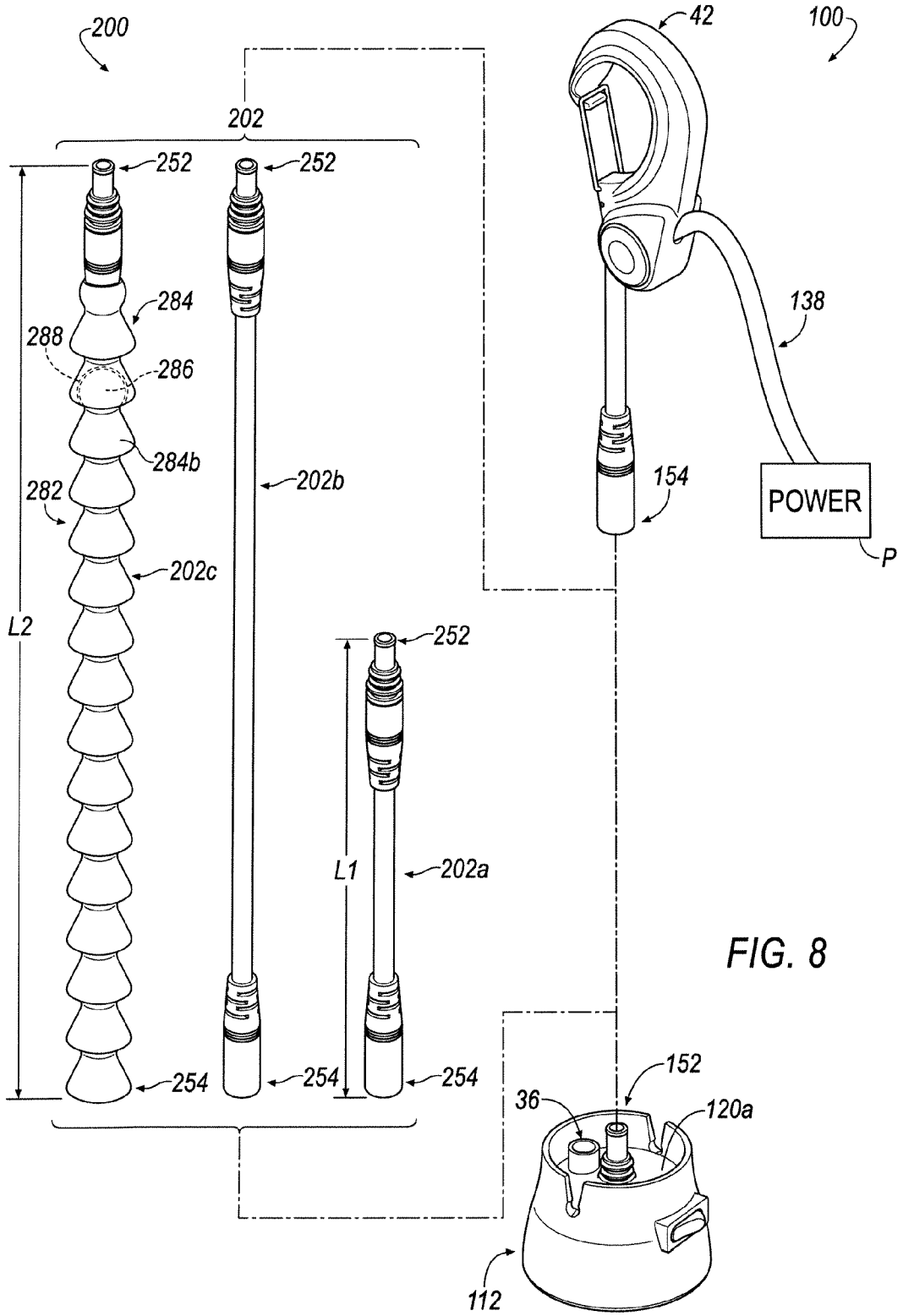
FIG. 8 is a view of a lighting apparatus kit in accordance with an exemplary embodiment of the invention.

Referring now to FIG. 8, a lighting apparatus kit is shown generally at 200 according to an embodiment of the invention. The lighting apparatus kit 200 includes the lighting apparatus 100 and a plurality of adapter conduits 202. The plurality of adapter conduits 202 may include one or more first adapter conduits 202*a*, one or more second adapter conduits 202*b* and one or more third adapter conduits 202*c*. In an embodiment, each conduit 202*a*, 202*b*, 202*c* of the plurality of conduits 202 includes structure that is substantially similar to that as described with respect to the conduit 38, which may include, for example, first and second electrically-conducting members 88*a*, 88*b*/188*a*, 188*b* for the purpose of communicating energy from the power source, P, to the one or more illumination components, I, in order to enable the one or more illumination components, I, to be illuminated.

Figure 9A:
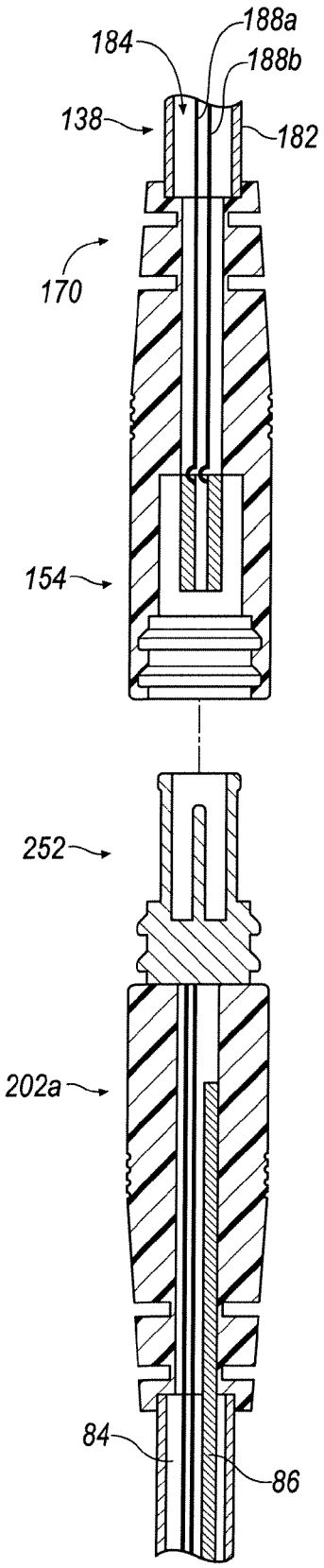
FIG. 9A is a disassembled, cross-sectional view of a lighting apparatus according to line 9-9 of FIG. 10 in accordance with an exemplary embodiment of the invention.
Figure 9B:
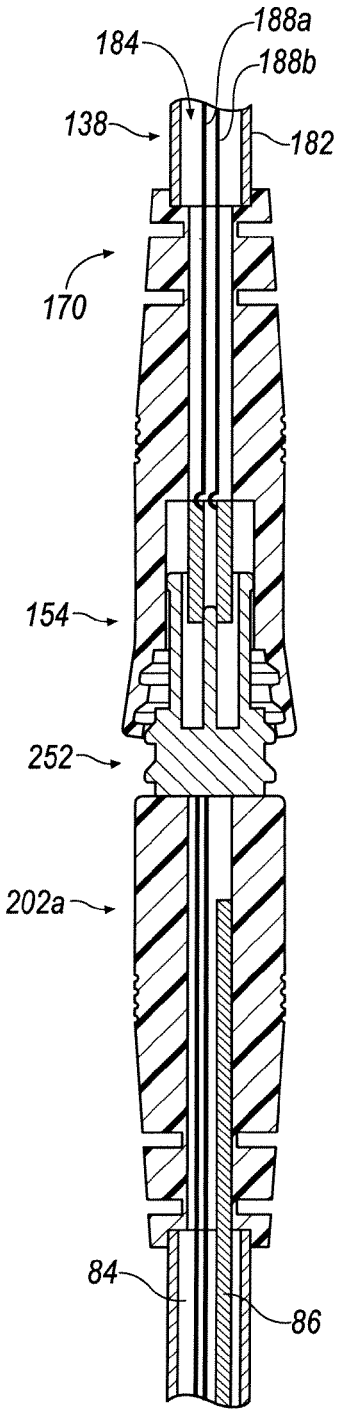
FIG. 9B is a partially-assembled, cross-sectional view of a lighting apparatus according to line 9-9 of FIG. 10 in accordance with an exemplary embodiment of the invention.
Figure 9C:
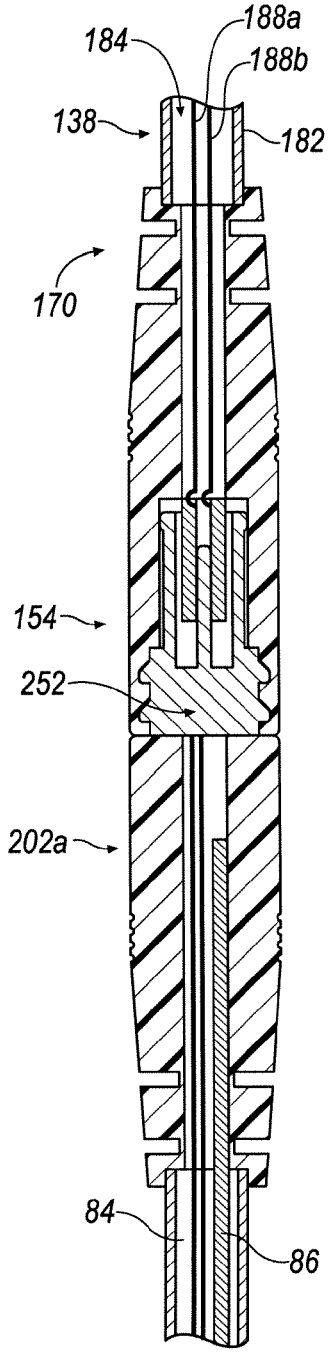
FIG. 9C is an assembled, cross-sectional view of a lighting apparatus according to line 9-9 of FIG. 10 in accordance with an exemplary embodiment of the invention.

In an embodiment, each of the one or more adapter conduits 202*a*, 202*b*, 202*c* includes a male portion 252 and a female portion 254. The male and female portions 252, 254 are substantially similar to the male and female portions 152, 154, and, as such, are not described in greater detail. Referring to FIGS. 8-9C, in an embodiment, the male portion 252 of the one or more adapter conduits 202*a*, 202*b*, 202*c* may be selectively-coupled to the female portion 154 of the lighting apparatus 100, and, in an embodiment, the female portion 254 of the one or more adapter conduits 202*a*, 202*b*, 202*c* may be selectively-coupled to the male portion 152 of the lighting apparatus 100.

Figure 10:
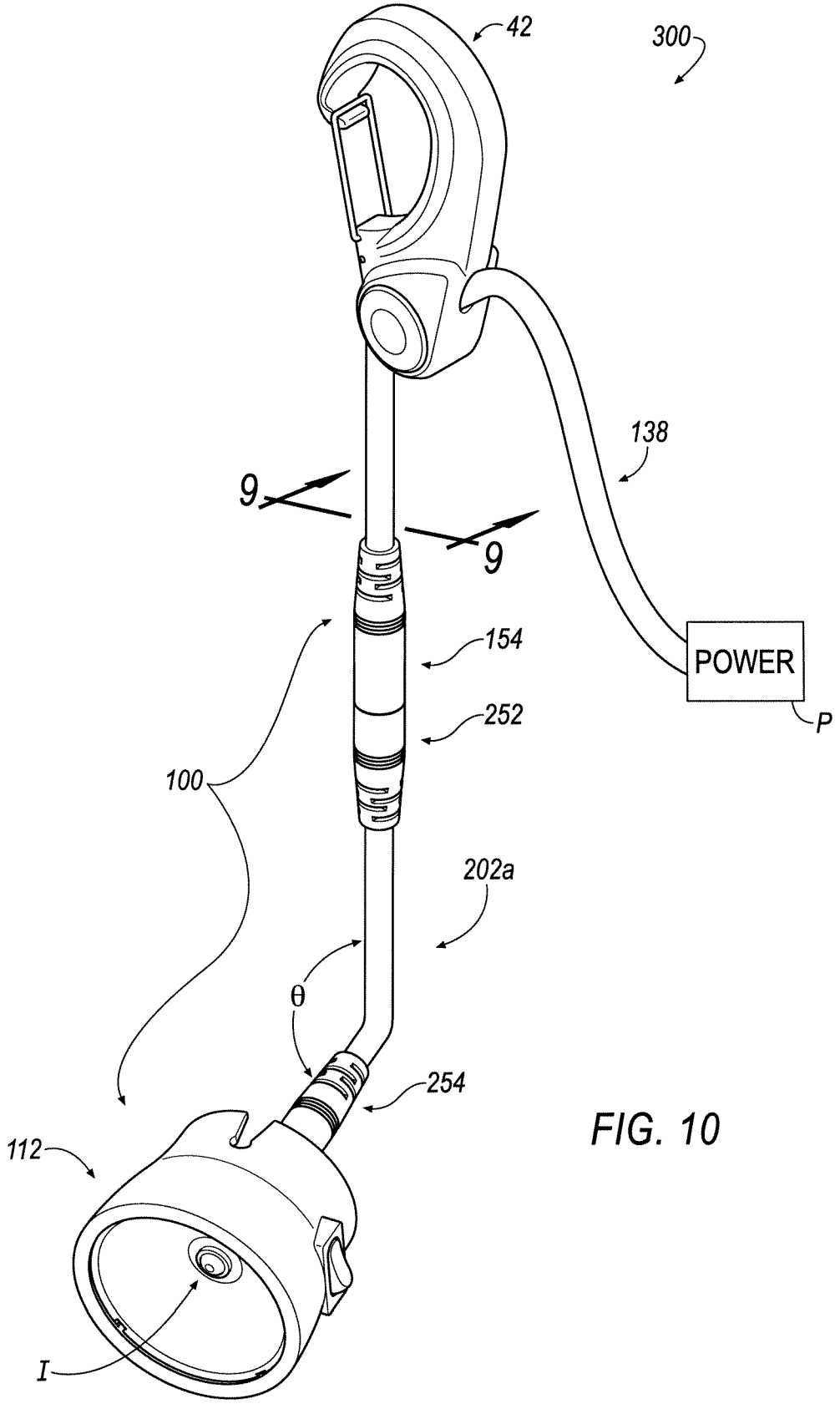
FIG. 10 is an isometric view of a lighting apparatus assembly formed from the lighting apparatus kit of FIG. 8 in accordance with an exemplary embodiment of the invention.

In an embodiment, when an adapter conduit 202*a*, 202*b*, 202*c* is selected from the plurality of adapter conduits 38 for subsequent connection to the lighting apparatus 100 as described above, a lighting apparatus assembly, which is shown generally at 300 in FIG. 10, is provided. It will be appreciated that the selected adapter conduit 202*a*, 202*b*, 202*c* provides several benefits when it is attached to the lighting apparatus 100.

Referring to FIG. 8, in an embodiment, a first benefit of including the plurality of adapter conduits 202 in the kit 200 is that the selected adapter conduit 202*a*, 202*b*, 202*c* renders an extension cord in order to provide an increased distance between the male portion 152 and the female portion 154 of the lighting apparatus 100. It will be appreciated that each adapter conduit 202*a*, 202*b*, 202*c* of the kit 200 does not include the same length. For example, in an embodiment, the first adapter conduit 202*a* may include a length, L1, that is less than a length, L2, of the second and third adapter conduits 202*b*, 202*c*.

In an embodiment, a second benefit of including the plurality of adapter conduits 202 in the kit 200 is that the selected adapter conduit 202*a*, 202*b*, 202*c* provides a non-rigid, shapeable/formable body. Because the selected adapter conduit 202*a*, 202*b*, 202*c* is shapeable/formable, it will be appreciated that the selected adapter conduit 202*a*, 202*b*, 202*c* may retain its shaped/formed/bent orientation (see, angle, θ, in FIG. 10); the benefit of retaining the shaped/formed/bent orientation, θ, is that the selected adapter conduit 202*a*, 202*b*, 202*c* may selectively direct light from the one or more illumination components, I, in a desired direction that is determined by the user that shapes/forms/bents the selected adapter conduit 202*a*, 202*b*, 202*c*.

In an embodiment, the ability to provide the shapeable/formable nature of the adapter conduits 202*a*, 202*b*, 202*c* may be realized in any desirable fashion. Referring to FIGS. 9A-9C, in an embodiment, the shapeable/formable nature of the adapter conduit 202*a*, 202*b*, 202*c* may be realized by extending the non-conducting member 86 through the inner passage 84 of each of the first and second adapter conduits 202*a*, 202*b*.

Referring to FIG. 8, alternatively, in an embodiment, an outer insulating sheath 282 of the adapter conduit 202*c* may contain a plurality of nested-bodies 284 including at least a first nested body 284*a* and a second nested body 284*b*. In an embodiment, each nested body 284*a*, 284*b* of the plurality of nested bodies 284 include a ball portion 286 and a socket portion 288. In an embodiment, the ball portion 286 of a second nested body 284*b* is inserted into a socket portion 288 of a neighboring, first nested body 284*a*. Upon re-orientating one of the first and second nest bodies 284*a*, 284*b* relative the other of the first and second nested bodies 284*a*, 284*b*, the re-orientated positioning may be retained by a frictional connection provided by the ball portion 286 and the socket portion 288.

Referring now to FIG. 10, a lighting apparatus assembly is shown generally at 300 in accordance with an exemplary embodiment of the invention. In an embodiment, the lighting apparatus assembly 300 is formed from the kit 200. In an embodiment, the lighting apparatus assembly 300 includes the lighting apparatus 100 and the adapter conduit 202*a* of the plurality of adapter conduits 202. Although the adapter conduit 202*a* of the plurality of adapter conduits 202 is utilized in forming the lighting apparatus assembly 300, it will be appreciated that either of the remaining adapter conduits 202*b*, 202*c* of the plurality of adapter conduits 202 may be alternatively-incorporated into the formation of lighting apparatus assembly 300, rather than utilizing the adapter conduit 202*a*. Further, as described above, it will be appreciated that a shaped/formed/bent angle, θ, of the adapter conduit 202*a* is retained for selectively-directing light from the one or more illumination components, I, in a desired direction.

Referring to each of FIGS. 1, 4 and 8, the port 36 is shown extending from first upper surface portion 20*a*, 120*a*. In an embodiment, the port 36 permits at least a first lighting apparatus 10, 100, 300 to be mechanically and electrically connected to a second lighting apparatus 10, 100, 300; in an embodiment, the above-described connection may render a term of art referred to as "daisy chaining" Referring to FIG. 11, a daisy-chained lighting apparatus assembly is shown generally at 400 in accordance with an embodiment of the invention.

Referring back to FIG. 6, in an embodiment, the port 36 is shown in electrical communication with the male portion 152 by way of a conductive lead 402. In an embodiment, the port 36 may form a female portion 454. The female portion 454 is substantially similar to the female portion 154, 254, and, as such, is not described in greater detail. In an embodiment, although the port 36 is formed to include a female portion 454, it will be appreciated that the port 36 may alternatively include a male portion that is substantially similar to the male portion 152, 252, if desired.

Figure 11:
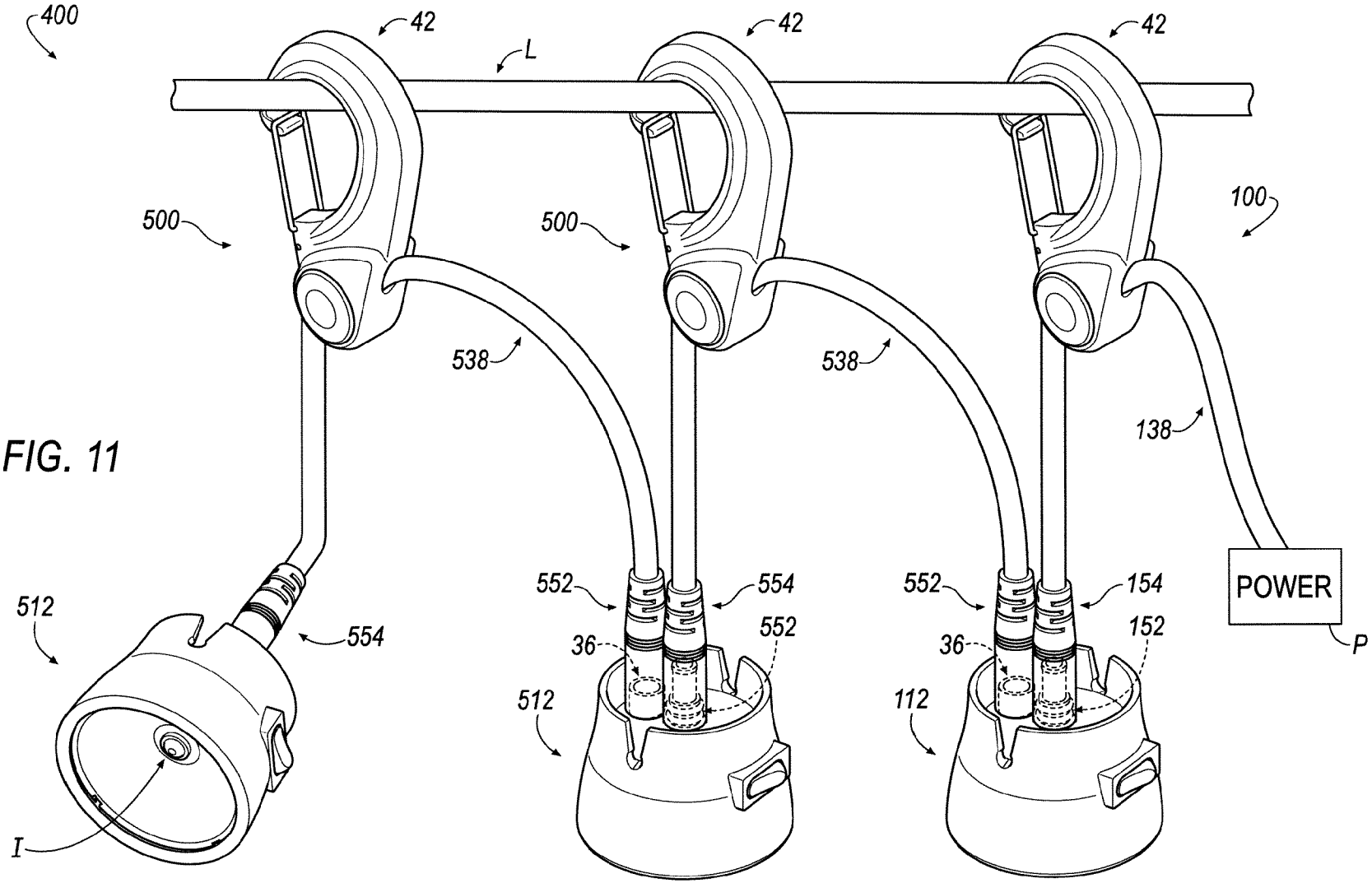
FIG. 11 is an isometric view of a daisy-chained lighting apparatus assembly in accordance with an exemplary embodiment of the invention.

Referring to FIG. 11, in an embodiment, the daisy-chained lighting apparatus assembly 400 may include the lighting apparatus 100 connected to one or more lighting apparatus, which is/are shown generally at 500 in accordance with an embodiment of the invention. In an embodiment, each lighting apparatus includes a conduit 538. In an embodiment, each lighting apparatus 500 is substantially similar to the lighting apparatus 100 except for the configuration of the conduit 538.

In an embodiment, the conduit 538 includes a first end 538' and a second end 538". In an embodiment, the first end 538' includes a female portion 554, and, in an embodiment, the second end 538" includes a male portion 552. The male and female portions 552, 554 are substantially similar to the male and female portions 152, 252/154, 254, and, as such, are not described in greater detail.

In an embodiment, the male portion 552 is removably-connected to the female portion 454 formed by the port 36 of a lighting apparatus 100, 500, and, in an embodiment, the female portion 554 is connected to a male portion 152, 452 extending from the first upper surface 20*a*, 120*a* of the body portion 112, 512. Once the male and female portions 552, 554 are connected as described above, the lighting apparatuses 100, 500 may be said to be electrically and mechanically connected to one another in order to form the daisy-chained lighting apparatus assembly 400.

Once the daisy-chained lighting apparatus assembly 400 is assembled as described above, the latch 42 of each lighting apparatus 100, 400 may be secured to an object, L, as similarly described above. Further, although the daisy-chained lighting apparatus assembly 400 is described to include the lighting apparatus 100, it will be appreciated that the daisy-chained lighting apparatus assembly 400 is not limited to including the lighting apparatus 100. For example, in an embodiment, the lighting apparatus 10 may be utilized in place of the lighting apparatus 100 in order to provide the daisy-chained lighting apparatus assembly 400.

The present invention has been described with reference to certain exemplary embodiments thereof. However, it will be readily apparent to those skilled in the art that it is possible to embody the invention in specific forms other than those of the exemplary embodiments described above. This may be done without departing from the spirit of the invention. The exemplary embodiments are merely illustrative and should not be considered restrictive in any way. The scope of the invention is defined by the appended claims and their equivalents, rather than by the preceding description.

What is claimed is:

1. A lighting apparatus, comprising:

a body portion;

a conduit coupled to the body portion;

one or more illumination components coupled to the body portion, wherein the one or more illumination components are in electrical communication with the conduit;

a latch coupled to the conduit and movably positionable along the conduit to adjust a height of the illumination components by adjusting a length of the conduit between the body portion and the latch.

2. The lighting apparatus according to claim 1, wherein the conduit includes an insulating sheath defining a bore, and one or more electrically-conducting members extending through the bore, the electrically-conducting members configured to communicate energy from a power source for enabling the one or more illumination components to be illuminated.

3. The lighting apparatus according to claim 2, wherein the conduit includes one or more shapeable, non-conducting members extending through the bore, wherein the one or more shapeable, non-conducting members are configured to retain a shaped orientation of the conduit.

4. The lighting apparatus according to claim 2, wherein the conduit includes an outer insulating sheath containing a plurality of nested-bodies including at least a first nested body and a second nested body, wherein each nested body of the plurality of nested bodies include a ball portion and a socket portion, wherein the ball portion of the second nested body is inserted into the socket portion of the first nested body, wherein the first and second nest bodies are relatively moveable and configured to retain a shaped orientation of the outer insulating sheath.

5. The lighting apparatus according to claim 1, wherein the body portion includes an outer side surface and an upper end connected to a lower end, wherein the upper end forms a lip portion, and wherein the lower end forms a base portion.

6. The lighting apparatus according to claim 5, wherein the upper end of the body portion includes an inner side surface, and wherein the outer side surface and the inner side surface forms the lip portion to include a circumferential thickness.

7. The lighting apparatus according to claim 6, wherein the body portion includes an upper surface including a first upper surface portion and a second upper surface portion, wherein the first upper surface portion is formed by the base portion, and wherein the second upper surface portion is formed by the lip portion, and wherein the lip portion forms the upper end of the body portion to include an axial passage, and wherein the axial passage extends between the first and second upper surface portions.

8. The lighting apparatus according to claim 7, wherein the lip portion forms one or more radial openings extending through the lip portion from the outer side surface to the inner side surface.

9. The lighting apparatus according to claim 8, wherein the one or more radial openings are configured to permit drainage of a fluid disposed within the axial passage.

10. The lighting apparatus according to claim 1, wherein the latch includes a base member, and an arm portion movably-connected to the base member, wherein the base member forms a channel and an enclosed passage, and wherein the conduit extends through the enclosed passage, and wherein the arm portion is configured to control lateral access of an object to the channel.

11. The lighting apparatus according to claim 10, wherein the latch further includes a button assembly, wherein the button assembly includes a button member that is movably-secured to the base member, and wherein the button member further includes an enclosed passage, and wherein the button member is movably-coupled to the base member so that the enclosed passage of the button member is configurable in one of an out-of-alignment orientation and an alignment orientation with respect to the enclosed passage formed by the base member, and wherein the alignment orientation results in the enclosed passages of the base member and the button member) forming an aligned passage.

12. The lighting apparatus according to claim 11, wherein the conduit also extends through the enclosed passage formed by the button member, and wherein the out-of-alignment orientation is configured to inhibit free movement of the latch relative the conduit, and wherein the alignment orientation is configured to permit free movement of the latch relative to the conduit.

13. The lighting apparatus according to claim 11, wherein the enclosed passage of the button member is formed to include one or more surface interruptions forming one or more ribs, and wherein the one or more ribs are configured to grip the conduit extending through the enclosed passage of the button member.

14. The lighting apparatus according to claim 1 further comprising a shade portion, wherein the shade portion includes a substantially tubular body having an upper surface that is connected to a lower surface of the body portion, and wherein the substantially tubular body is configured to direct light from the one or more illumination components.

15. The lighting apparatus according to claim 1, wherein body portion forms an upper surface, and wherein the upper surface includes a male portion, and wherein the conduit includes a female portion, and wherein the male portion is coupled to the female portion, and wherein the coupling of the male portion and the female portion permits the conduit to be in electrical communication with the one or more illumination components.

16. The lighting apparatus according to claim 15, further comprising a conduit adapter including a male portion and a female portion, wherein the male portion of the conduit adapter is coupled to the female portion of the conduit, and wherein the female portion of the conduit adapter is coupled to the male portion formed by the upper surface of the body portion, and wherein the coupling of the male portion of the conduit adapter to the female portion of the conduit and the female portion of the conduit adapter to the male portion formed by the upper surface of the body portion permits the conduit to be in electrical communication with the one or more illumination components by way of the conduit adapter.

17. The lighting apparatus according to claim 1, wherein body portion forms an upper surface, the upper surface including a port, wherein the port is in electrical communication with the conduit by way of a conductive lead arranged within the body portion, and wherein the port is configured to form a daisy-chained lighting apparatus assembly of a plurality of lighting apparatuses, wherein the port is connected to a neighboring conduit of a neighboring lighting apparatus.

18. A lighting apparatus kit, comprising:

a plurality of conduit adapters, each conduit adapter including a first end and a second end;

a conduit adapted to be coupled to the first end of a selected conduit adapter of the plurality of conduit adapters, a body portion adapted to be coupled to the second end of the selected conduit adapter of the plurality of conduit adapters; and one or more illumination components coupled to the body portion, wherein the one or more illumination components are in electrical communication with the conduit by way of the selected conduit adapter of the plurality of conduit adapters; and a latch coupled to the conduit and movably positionable along the conduit to adjust a height of the illumination components by adjusting a length of the conduit between the body portion and the latch.

19. A daisy-chained lighting apparatus assembly, comprising:

at least two lighting apparatuses, each lighting apparatus including:

a body portion including an upper surface, wherein the upper surface includes a port;

a conduit coupled to the body portion, wherein the port is in electrical communication with the conduit by way of a conductive lead arranged within the body portion, and wherein the port is connected to a neighboring conduit of a neighboring lighting apparatus to permit daisy-chaining the at least two lighting apparatuses;

one or more illumination components coupled to the body portion, wherein the one or more illumination components are in electrical communication with the conduit; and a latch coupled to the conduit and movably positionable along the conduit to adjust a height of the illumination components by adjusting a length of the conduit between the body portion and the latch.

20. A lighting apparatus, comprising:

a body portion;

a conduit coupled to the body portion;

one or more illumination components coupled to the body portion, wherein the one or more illumination components are in electrical communication with the conduit;

a latch movably-coupled to the conduit, wherein the latch includes a base member, and an arm portion movably-connected to the base member, wherein the base member forms a channel and an enclosed passage, and wherein the conduit extends through the enclosed passage, and wherein the arm portion is configured to control lateral access of an object to the channel;

wherein the latch further includes a button assembly having a button member that is movably-secured to the base member, and wherein the button member further includes an enclosed passage, and wherein the button member is movably-coupled to the base member so that the enclosed passage of the button member is configurable in one of an out-of-alignment orientation and an alignment orientation with respect to the enclosed passage formed by the base member, and wherein the alignment orientation results in the enclosed passages of the base member and the button member forming an aligned passage.

21. The lighting apparatus according to claim 20, wherein the body portion forms an upper surface, the upper surface including a port, wherein the port is in electrical communication with the conduit by way of a conductive lead arranged within the body portion, and wherein the port is configured to form a daisy-chained lighting apparatus assembly of a plurality of lighting apparatuses, wherein the port is connected to a neighboring conduit of a neighboring lighting apparatus.

22. The lighting apparatus according to claim 20 further comprising a shade portion, wherein the shade portion includes a substantially tubular body having an upper surface that is connected to a lower surface of the body portion, and wherein the substantially tubular body is configured to direct light from the one or more illumination components.

* * * * *